United States Patent [101]

Groff

[11] 4,052,764

[45] Oct. 11, 1977

[54] BAG ACCESSORY

[75] Inventor: Harold M. Groff, Santa Ana, Calif.

[73] Assignee: Donald M. Groff, Medford, N.J. ; a part interest

[21] Appl. No.: 659,260

[22] Filed: Feb. 19, 1976

[51] Int. Cl.[2] ..... A47L 13/52; B65B 67/12

[52] U.S. Cl. ..... 15/257.9; 248/95; 248/99; 294/1 R

[58] Field of Search ..... 15/257.1, 257.4, 257.6, 15/257.8, 257.9, 104.8; 248/99, 101; 141/108; 294/1 R, 55

[56] References Cited

U.S. PATENT DOCUMENTS

| | | | |
|---|---|---|---|
| 141,186 | 7/1873 | Thomas | 248/101 |
| 430,355 | 6/1890 | Stone | 141/108 |
| 608,635 | 8/1898 | Bartholomew | 15/257.9 |
| 1,266,522 | 5/1918 | Oldham | 141/108 |
| 3,121,248 | 2/1964 | Ferguson | 15/257.9 |
| 3,688,483 | 9/1972 | Hamilton | 294/55 X |
| 3,754,785 | 8/1973 | Anderson | 248/99 X |
| 3,936,087 | 2/1976 | Alexander | 15/257.1 X |

FOREIGN PATENT DOCUMENTS

| | | | |
|---|---|---|---|
| 162,168 | 1/1949 | Austria | 141/108 |

*Primary Examiner*—Daniel Blum
*Attorney, Agent, or Firm*—Robert K. Youtie

[57] ABSTRACT

A bag accessory for attachment to a bag, which accessory includes a ramp or scoop for guiding refuse or other material from a work surface into an attached bag, gripping means carried by the ramp or scoop for releasably gripping the bag, arms for distending or holding the bag open, and suspension means for hanging the bag as for a trash receptacle, or the like.

7 Claims, 3 Drawing Figures

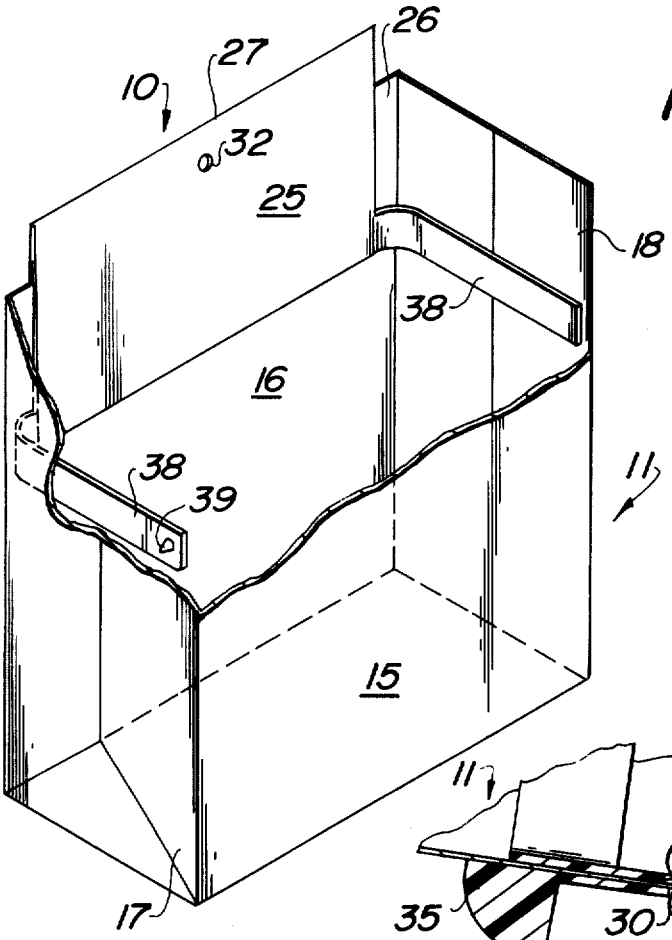
FIG. 1
FIG. 3
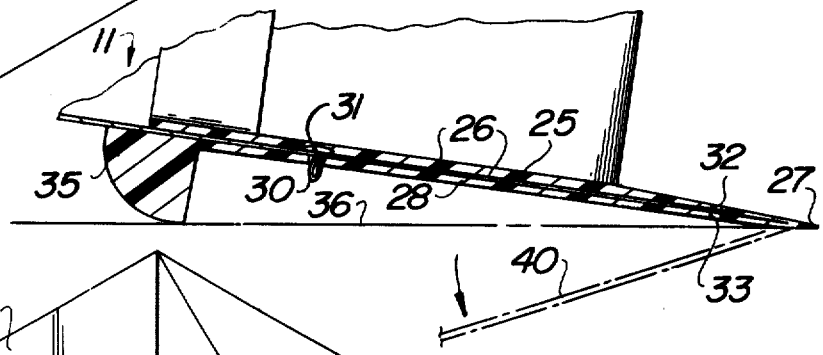
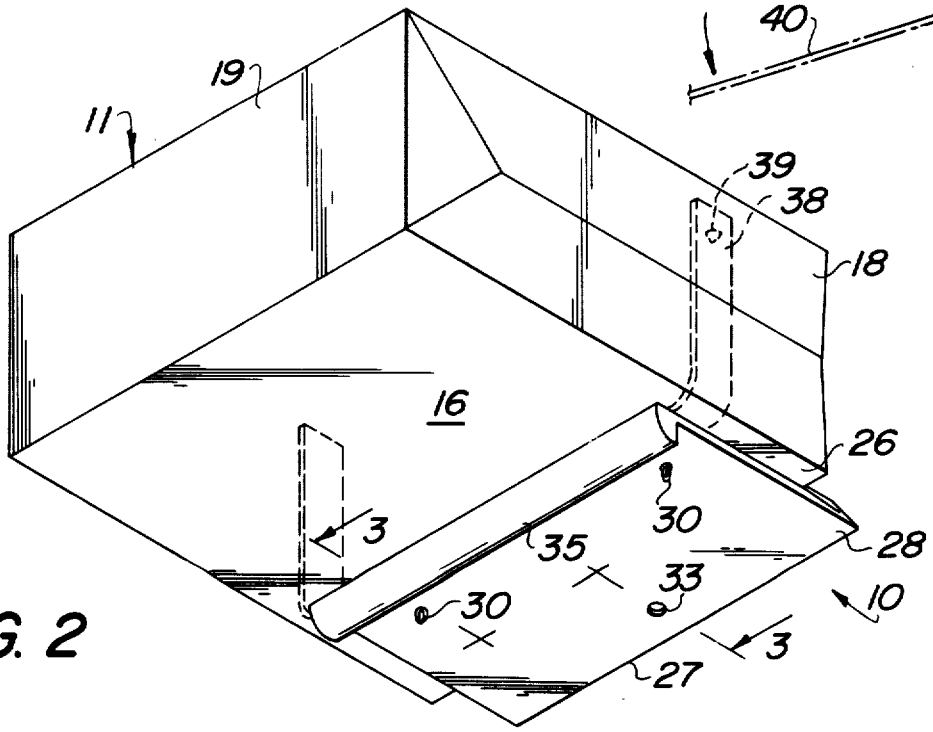
FIG. 2

BAG ACCESSORY

BACKGROUND OF THE INVENTION

While it is appreciated that the prior art has proposed a variety of devices as accessories for utilizing grocery bags, and the like, these accessory devices have not found general acceptance with consumers, being unduly limited in application and use, complex in construction and readily subject to malfunction and damage, and high in cost for the potential benefits to be derived.

SUMMARY OF THE INVENTION

It is, therefore, an important object of the present invention to provide an accessory device for use with grocery bags and the like which is highly versatile in application and operation for quick and convenient use both in sweeping, dusting and the like removal of refuse and other material from a work surface, as well as mounting in a convenient location as a receptacle for convenient gravitational deposit therein of trash and other material.

It is still another object of the present invention to provide an accessory device for grocery bags, and the like, having the advantageous characteristics mentioned in the preceding paragraph, which is very quickly and easily attachable to and removable from a bag without special training or skill.

It is still another object of the present invention to provide a bag accessory of the type described which is extremely simple in construction, for economy in cost, durability and reliability throughout a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a bag accessory of the present invention in operative association with a bag, the latter being partly broken away for clarity of illustration.

FIG. 2 is a bottom perspective view showing the assembly of FIG. 1, but arranged for use on a work surface.

FIG. 3 is a partial sectional elevational view, somewhat enlarged for clarity, taken generally along the line 3—3 of FIG. 2.

DESCRIPTION OF THE PREFERRED EMBODIMENT

Referring now more particularly to the drawings, and specifically to FIG. 1 thereof, an accessory device of the present invention is there generally designated 10, and illustrated in operative association with a grocery bag 11, arranged as an assembly with the bag located for gravitationally receiving the deposit of trash, and the like.

In the disposition of FIG. 2, the assemblage of accessory 10 and bag 11 is shown in position for location on a floor or other work surface as in dusting or sweeping of refuse into the bag.

The bag 11 may be conventional, say fabricated of kraft paper, or the like, including generally rectangular front and back walls 15 and 16, side walls 17 and 18 extending between the front and back walls, and a bottom wall 19 extending between the lower edges of the front, back and side walls 15-18.

The accessory device 10 may include a generally flat, substantially rectangular inner plate or ramp member 25 which is illustrated as being located within the open end or mouth of the bag 11, in facing engagement with the open end edge portion 26 of the rear bag wall 16, extending laterally substantially between the side walls 17 and 18. Further, the flat inner plate or ramp member 25 extends outwardly through and beyond the open end or mouth of bag 11 to terminate in a relatively sharp outer or distal edge 27.

In generally facing relation with the inner plate or ramp member 25, but outwardly of the bag edge portion 26, is an outer, generally flat plate or gripping member 28. That is, the outer plate or gripping member 28 may be generally rectangualr, approximately congruent to the inner plate or ramp member 25, outward of the bag edge portion 26 and hingedly connected to the ramp member adjacent to the distal ramp edge 27 for swinging movement relative to the ramp member into and out of a sandwiching or gripping relation with the interposed bag edge portion 26.

The inner plate or ramp member 25 and outer plate or gripping member 28 may advantageously be fabricated of plastic, if desired, or other suitable material, and may be formed integrally with a hinged distal edge at 27, or formed separately and otherwise hinged, if desired.

Outstanding from the under or outer side of ramp member or inner plate 25 may be one or more impaling elements or studs 30, say for piercing action through the interposed or sandwiched bag portion 26. Further, the impaling elements or studs 30 may engage frictionally through respective openings or holes 31 in the outer plate or gripping member 28. Thus, the studs or impaling pins 30 cooperate with the plates 25 and 28 to effect positive gripping action of the intermediate bag portion 26 and effectively retain the accessory 10 in gripping relation with the bag.

The inner plate or ramp member 25 may be further formed with a through hole 32, and the outer plate or gripping member 28 is further formed with a through hole 33 movable into and out of registry with the hole 32. The aligned holes 32 and 33 are thus adapted for receiving a hook, or the like to define suspension means for supporting the assemblage in the upright receptacle condition shown in FIG. 1.

Remote from the distal ramp edge 27, the outer side of the outer flat plate or gripping member 28 is provided with a laterally extending outstanding rib or support 35 which projects beyond the impaling members or pins 30 in the assembled condition, see FIG. 3. Thereby, the rib or support 35 is engageable with a nether work surface 36, simultaneously with engagement of distal ramp edge 27 with the surface 36 to maintain the ramp 25 at a proper inclination with respect to the work surface for guiding material from the surface to the interior of bag 11. As the support 35 projects outwardly from gripping member 28 beyond the through projection of pins 30, the latter do not adversely affect the desired angle of ramp repose.

In addition, the inner plate or ramp member 25 is provided at opposite side edges, remote from the distal ramp edge 27, with a pair of generally parallel arms or distention members 38, which extend generally away from the gripping member 28 interiorly of the bag 11 along opposite bag side walls 17 and 18. The distention members or arms 38 thereby serve to maintain the bag mouth open, and may be provided on their free ends with projections or pins 39, say for engagement through respective bag side walls.

Of course, when the bag 11 is full to the desired extent, it is only necessary to swing the gripping member or plate 28 outwardly, as shown in phantom in FIG. 3 in the direction of arrow 40, so that the pins 30 may be withdrawn from the bag wall region 26, and the device 10 removed from the bag. A new bag may, obviously, be replaced by reversal of the above procedure.

From the foregoing, it is seen that the present invention provides a bag accessory which is extremely simple in construction, greatly facilitates bag use both as an upright receptacle for the gravitational deposit of trash, and as an inclined ramp or scoop for receiving sweepings, and the like, from a work surface.

Although the present invention has been described in some detail by way of illustration and example for purposes of clarity of understanding, it is understood that certain changes and modifications may be made within the spirit of the invention.

What is claimed is:

1. A bag accessory comprising a ramp member for location in the bag mouth and extending therebeyond to and terminating in a distal edge, bag gripping means carried by said ramp member for releasably securing a bag to the ramp member in the bag mouth, bag distention means associated with said ramp member for holding a gripped bag open, said ramp distal edge being engageable with a work surface for guiding material from the surface into an open bag, suspension means associated with said ramp member for selectively suspending said bag in open position to receive gravitationally falling material, said bag gripping means comprising a gripping member hingedly connected to said ramp member adjacent to said distal ramp edge for swinging movement toward and away from said ramp member and combining therewith to releasably grip an interposed bag edge portion, and support means on said gripping member remote from said distal ramp edge and engageable with said work surface to maintain said ramp in inclined relation.

2. A bag accessory according to claim 1, said gripping means including impaling means engageable through the bag mouth portion.

3. A bag accessory comprising a ramp member for location in the bag mouth and extending therebeyond to and terminating in a distal edge, bag gripping means carried by said ramp member for releasably securing a bag to the ramp member in the bag mouth, bag distention means associated with said ramp member for holding a gripped bag open, said ramp distal edge being engageable with a work surface for guiding material from the surface into an open bag, and suspension means associated with said ramp member for selectively suspending said bag in open position to receive gravitationally falling material, said gripping means including impaling means engageable through the bag mouth portion, said impaling means being carried by said ramp member, and said gripping means further comprising a gripping member having an opening and hingedly connected to said ramp member adjacent to said distal ramp edge for swinging movement toward said ramp member to receive said impaling means in said opening and away from said ramp member to release said impaling means from said opening.

4. A bag accessory according to claim 3, in combination with support means on said gripping member remote from said distal ramp edge projecting beyond said impaling means and engageable with said work surface to maintain said ramp in inclined relation.

5. A bag accessory according to claim 3, said gripping member further comprising a generally flat plate.

6. A bag accessory according to claim 3, said suspensions means being defined by registrable openings in said ramp member and gripping member.

7. A bag accessory according to claim 1, said distention means comprising arms extending from opposite sides of said ramp member in the direction away from said gripping means.

* * * * *